US005581969A

United States Patent [19]

Kelleher

[11] Patent Number: 5,581,969

[45] Date of Patent: Dec. 10, 1996

[54] PREFABRICATED BUILDING ELEMENT

[76] Inventor: Stephen L. Kelleher, P. O. Box 107, Mattapoisett, Mass. 02739

[21] Appl. No.: 322,276

[22] Filed: Oct. 13, 1994

[51] Int. Cl.[6] ..... E04B 2/00

[52] U.S. Cl. ..... 52/602; 52/309.9; 52/309.14; 52/404.4; 52/405.4; 52/481.1; 52/582.1; 52/630; 52/783.11; 52/783.19; 52/800.1; 52/802.11

[58] Field of Search ..... 52/602, 608, 309.7, 52/309.9, 309.13, 309.14, 309.12, 404.1, 404.4, 405.1, 405.4, 783.11, 783.19, 797.1, 798.1, 630, 578, 592.6, 800.1, 801.1, 801.11, 802.1, 802.11, 799.1, 414, 481.1, 582.1; D25/138

[56] References Cited

U.S. PATENT DOCUMENTS

| | | | |
|---|---|---|---|
| 1,547,012 | 7/1925 | Arnn | 52/612 X |
| 2,068,098 | 1/1937 | Elmendorf . | |
| 2,202,745 | 5/1940 | Muse | 52/602 X |
| 2,284,229 | 5/1942 | Palmer | 52/578 |
| 2,324,039 | 7/1943 | Stone | 52/602 X |
| 2,332,705 | 10/1943 | Fellom . | |
| 2,409,819 | 10/1946 | Wilson | 52/783.11 |
| 2,570,234 | 10/1951 | Harris . | |
| 3,209,503 | 10/1965 | Mostoller | 52/404.1 |
| 3,397,500 | 8/1968 | Watson, Jr. . | |
| 3,401,494 | 9/1968 | Anderson | 52/309.7 X |
| 3,435,581 | 4/1969 | Ahlqvist | 52/405.1 |
| 4,095,383 | 6/1978 | Strobl | 52/309.7 |
| 4,147,004 | 4/1979 | Day et al. | 52/797.1 X |
| 4,837,999 | 6/1989 | Stayner | D25/138 X |
| 5,353,563 | 10/1994 | White | 52/309.13 |
| 5,433,049 | 7/1995 | Karlsson et al. | 52/602 X |

FOREIGN PATENT DOCUMENTS

| | | | |
|---|---|---|---|
| 1267545 | 4/1990 | Canada | 52/578 |
| 78959 | 4/1950 | Czechoslovakia | 52/592.6 |
| 766251 | 6/1934 | France | 52/602 |
| 931966 | 3/1948 | France | 52/608 |
| 2322245 | 2/1977 | France | 52/602 |
| 2463839 | 4/1981 | France | 52/299 |
| 2663662 | 12/1991 | France | 52/602 |
| 2405046 | 8/1975 | Germany | 52/302.1 |
| 838041 | 6/1981 | U.S.S.R. | 52/405.1 |
| 786415 | 11/1957 | United Kingdom | 52/578 |
| WO83/03276 | 9/1983 | WIPO | 52/602 |

*Primary Examiner*—Carl D. Friedman
*Assistant Examiner*—Laura A. Saladino
*Attorney, Agent, or Firm*—Hayes, Soloway, Hennessey, Grossman & Hage, P.C.

[57] ABSTRACT

A modular building panel construction comprises an elongated panel member having a least one generally V-shaped reinforcing stud member formed integrally with or secured to one surface of the panel. The reinforcing stud member runs parallel to the long dimension of the panel, and is located along the long side edge of the panel member and extend laterally beyond the edge of the panel member. The other long edge of the panel member is free from any reinforcing stud members. The building panel may be made without any old growth lumber.

30 Claims, 4 Drawing Sheets

PREFABRICATED BUILDING ELEMENT

This invention relates generally to improvements in building systems, and more particularly to an improved building system based on novel building panels, and the method of assembly thereof.

Present day building structures generally either have load carrying beam and structural supports which are provided primarily for their load support with the wall structure primarily considered for its enclosing features, or panels which due to their overall shape or elaborate internal structure provide suitable load carrying characteristics and when a plurality of such units are structurally interlocked provide a load carrying wall system.

Present day construction methods generally require a large amount of on-the-site fabrication of wall structures, and may also require the erection of scaffolding for the entire height of the structure. This is particularly true with conventional insulated double wall construction wherein the structural framework is first erected, then girts, inner walls, sub-girts, insulation and finally the outer walls. On-the-site fabrication is labor intensive, wasteful of materials and the resulting product is heavily dependent upon the skills and caring of the individual worker. On-the-site fabricated wall structures or so-called "stick built" structures may suffer from air infiltration or leakage, and heat loss through the studs.

The foregoing discussion of the prior art was taken largely from U.S. Pat. No. 3,397,500 to Watson who proposed a building structure comprising preformed panels held in place between wedging structural members. More particularly, in accordance with the teachings of U.S. Pat. No. 3,397,500, a building structure is provided comprising a plurality of alternating structural members and panels. The structural members comprise elongated, preformed, load-bearing element of cross-section having opposing sides converging to an apex and a flange extending laterally from each side of the apex. Each of the flanges terminates with the leg extending towards the proximate of the opposing sides so as to exert a wedging action when the panel is maintained with one edge adjacent the proximate side in a plane approximately parallel to the flange and subject to a force directed to the proximate side. According to the teachings of U.S. Pat. No. 3,397,500, the panels are maintained under lateral compressive force from adjacent structural members. The wedging action of the combination of the structural members and the panels purportedly produces a generally weatherproof and rigid building structure. Notwithstanding the foregoing, the patented building structure as disclosed in U.S. Pat. No. 3,397,500 is not believed to have achieved any degree of commercial success.

It is therefore a principal object of the present invention to overcome the aforesaid and other disadvantages of the prior art. Another and more specific object of the present invention is to provide a building structure which is compatible with existing materials and building standards, and does not require special equipment to assemble or fabricate on site.

The present invention overcomes the aforesaid and other problems of the prior art by providing, in one aspect, a novel building system based on elongated modular building panels each having a generally V-shaped reinforcing stud formed integrally with, or secured to one surface of the panel and running parallel to the long dimension of the panel. The stud is secured along a long side edge of the panel and extends laterally beyond the edge of the panel, while the other long edge of the panel is free from any reinforcing studs. If desired, additional reinforcing studs may be secured to the one surface of the panel, running parallel to the long dimension of the panel, and spaced, for example 16 iinches or 24 inches on center. The panels comprise a composite flake board, plywood, or other laminated or molded product, while the stud or studs may comprise similar materials formed integrally with the panels, e.g. as by molding. Alternatively, the studs may be formed separately from the panels, and secured to the panels by suitable fastening means. In such case, the studs preferably comprise wood fiber and/or foam-filled, metal-skinned members. In a particularly preferred embodiment of the invention, the center portions of the studs are foam-filled, while the ends of the studs are wood fiber filled, for example, 6 to 12 inches from the ends. In one aspect, a typical panel may be 4 feet by 8 feet, with studs located 16 inches or 24 inches on center. Such building panels are particularly useful for forming load-bearing exterior walls. In another aspect of the invention, the modular building panel comprises an elongate panel of 16 inches or 24 inches width, and has only a single generally V-shaped reinforcing stud which is secured to one side edge of the panel and parallel to the long dimension, extending laterally beyond the edge of the panel. As before, the other long edge of the panel is free of reinforcing studs. Such building panels are useful for forming load bearing floors and/or roofs.

Still other objects and advantages of the present invention will become apparent from the following detailed description of a preferred embodiment of the invention, when taken with the accompanying drawings, wherein like numerals depict like parts, and wherein.

With particular reference to FIGS. 1–4 of the drawings, a building panel in accordance with one aspect of the present invention comprises a generally flat panel 10. Panel 10 typically comprises a modular building size such as 4 feet wide by 8 feet long so as to provide a wall height of 8 feet between the floor and header which is typical, for example, in the case of home construction. However, other dimensions may be provided, for example, for commercial structures and foreign markets. Panel 10 typically comprises a composite flake board or plywood sheet. However, panel 10 may comprise other composite or molded materials including, for example, mineral-filled or recycled paper-filled composites, or the like.

A plurality of stud members 12*a*, 12*b*, 12*c* are formed integrally with the inside wall surface 14 of panel 10, or are separately formed and affixed to the inside wall surface 14 with suitable fastening means such as construction adhesive. Preferably, however, the stud members are separately formed and are affixed to the panel 10 by mechanical fasteners such as staples, nails or screws 16. In a particularly preferred embodiment of the invention, the stud members are affixed to the panel by means of integrally formed gang nail strips as will be described in detail hereinafter.

Figure 1:
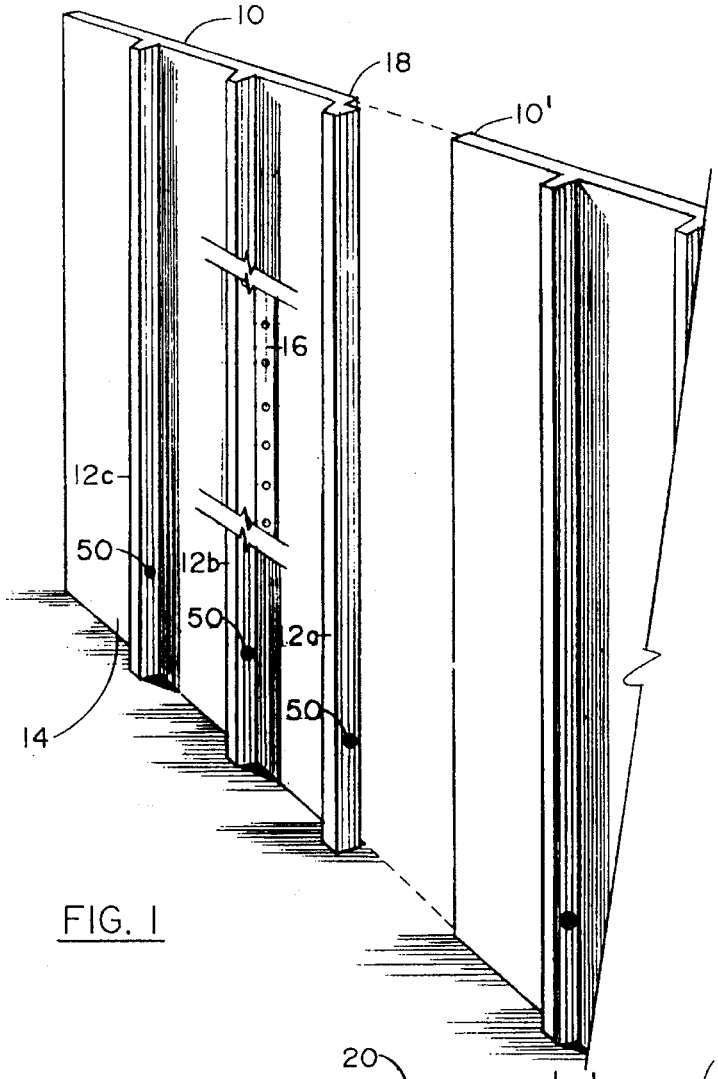
FIG. 1 is a side elevational view of a portion of a wall structure embodying the principals of the present invention.
Figure 2:
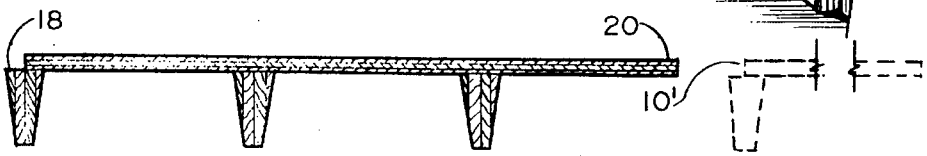
FIG. 2 is a top plan view of the building structure of FIG. 1.
Figure 3:
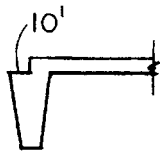
FIG. 3 is an enlarged top plan view similar to FIG. 2, and showing details of the interlock between adjacent wall panels made in accordance with the present invention.

Studs 12*a*, 12*b*, 12*c* run parallel to one another and are spaced from one another 16-inch on center, with the stud 12*a* nearest one long edge 18 of the panel extending laterally beyond the edge by about one-half its width. The other long edge 20 of the panel 10 is devoid of studs. Extending stud 12*a* beyond the long edge 18 of the panel provides a bearing surface so that a second panel 10' can be butted against a first panel 10 and affixed to the protruding surface 24 of the stud 12*a* by means of glue and/or mechanical fasteners. As seen in FIG. 3, the overlap also provides an interlock so as to seal the resulting building structure against air infiltration.

Figure 4:
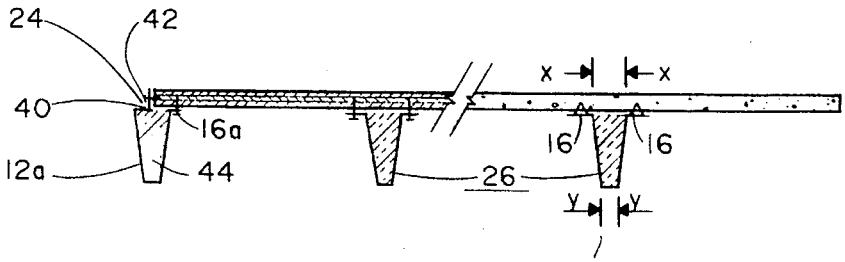
FIG. 4 is a cross-sectional view taken along line 4—4 of FIG. 1.

Referring in particular to FIG. 4, studs 12*a*, 12*b*, 12*c* each are generally V-shaped tapered or truncated in cross-section. Preferably, but not necessarily, the edges of studs 12*a*, 12*b*, 12*c* in contact with the panel 10 have a nominal width x—x equal to a conventional finished 2×4 or 2×6 construction stud, i.e. 1¾ inches. The free edges of studs 12*a*, 12*b*, 12*c* on the other hand have a slightly smaller width y—y of approximately 1¼ inches. Tapering the studs in this manner permits use of both fiberglass or rigid insulation panels of standard width which may be simply friction-fitted into the cavity between adjacent studs.

Studs 12*a*, 12*b*, 12*c* may be formed integrally with the panel. Alternatively, the studs may comprise wood fiber and/or foam-filled metal-skinned elongate members. In such case, the metal skin 26 typically comprises a relatively thin (e.g. 16 to 26 gauge) sheet metal element formed in a generally truncated shape. Studs 12*b* and 12*c* are affixed to the inside wall 14 of the panel 10 by means of mechanical fastening devices such as screws, nails or staples, or the studs may be adhesively affixed to the panel 10 by means of a construction adhesive. Of course, both mechanical and adhesive affixing may be used, if desired. In a preferred embodiment of the invention, nailing strips 16 comprising outwardly extending flanges formed integrally with the metal skins, and include gang nails which are integrally formed in flanges 16 for attaching the stud members to the inside wall 14 of the panel 10.

The stud member 12*a* affixed overlapping the edge 18 of panel 10 includes a single integrally formed outwardly extending flange 16*a* for affixing to the inside wall surface 14 of the panel 10, and a second integrally formed L-shaped flange 40 which depends from the free edge of the stud 12*a*. Flange 40 is directed inwardly essentially to the midpoint line 44 of the stud 12*a*, and has an upstanding leg 42 formed essentially along the midpoint line 44 of the stud 12*a*. Leg 42, which has a width approximately the same width as the thickness of panel 10, serves as a nailing flange for attaching the stud 12*a* to the long edge 18 of the panel 10. As before, in a preferred embodiment of the invention, leg 42 has integrally formed gang nails for affixing the leg 42 to the long edge 18 of the panel 10.

Referring again to FIG. 1, predrilled holes with knockout cores 50 are provided at a standard height in each stud 12*a*, 12*b*, 12*c* for running electric wires and/or plumbing.

To assemble a wall in accordance with the present invention, a first panel is placed in position, and a second panel butted up against with the edge stud bridging the elongated edges of the two panels. A header is then fastened to the tops of the studs, for example, by nailing through the header into the studs, and the free edge of the panel fastened to the overlapping stud. Similarly, additional panels may be affixed to adjacent panels to form a wall of desired length.

The modular building panel structure in accordance with the present invention may be erected employing conventional tools. Moreover, the panels may be cut, for example, to accommodate windows and doors, using conventional tools. While the studs may have a metal skin, the skin is sufficiently thin so no special metal-cutting tools are required.

Figure 8:
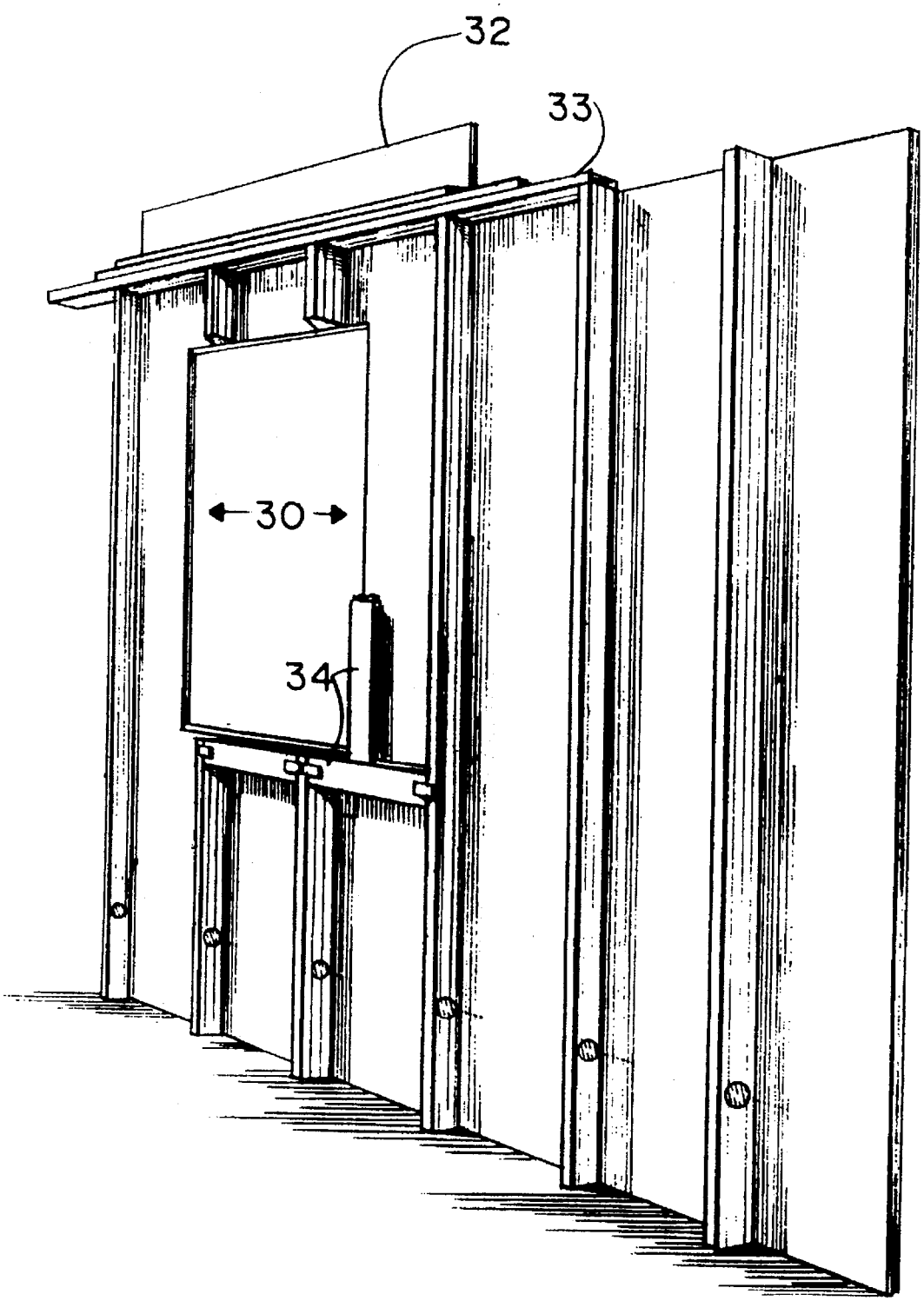
FIG. 8 shows details of a window opening in a building wall structure made in accordance with the present invention.

Referring to FIG. 8, after erecting the wall, in order to accommodate a window or door, a suitably sized opening 30 is cut in the panel. However, unlike conventional stick built walls, it is not necessary to build a header directly over the top edge of the opening. Rather, when using prefabricated building panels in accordance with the present invention, the structural integrity of the panels permits the elimination of the header in its conventional location. Instead, a header 32 comprising an elongate right angle member typically formed of ⅛" to ⅜" steel, and having a short leg dimension equal to the width of the top plate and a long leg dimension typically equal to the length of the ceiling joists may be affixed over the top plate 33. Header 32 should be long enough to bridge opening 30 and extend to either side of opening 30 to rest on the full studs running to either side of the opening. Employing a preformed steel header in accordance with the present invention simplifies construction in the field. Long spans, e.g. for wide window or door openings that eliminate more than three studs may require additional vertical reinforcing studs (shown in phantom in FIG. 8) underlying the ends of the header 32. Finally, wooden nailing backers 34 are clipped to the inside wall or panel surrounding the opening 30.

As can be seen from the foregoing description of the invention, the building panels of the present invention provide several significant advantages over conventional stick-built structures. For one, essentially no old growth forest products are needed. Moreover, the building panels made in accordance with the present invention are compatible with existing building standards and building materials. And, predrilling holes for electrical and plumbing runs, i.e. at the factory, facilitates and speeds construction in the field, and also guarantees that electrical runs, etc. will be at the correct height to meet Code. Manufacturing the building panels at the factory, saves time on the job site and also guarantees straight, square construction.

Figure 9:
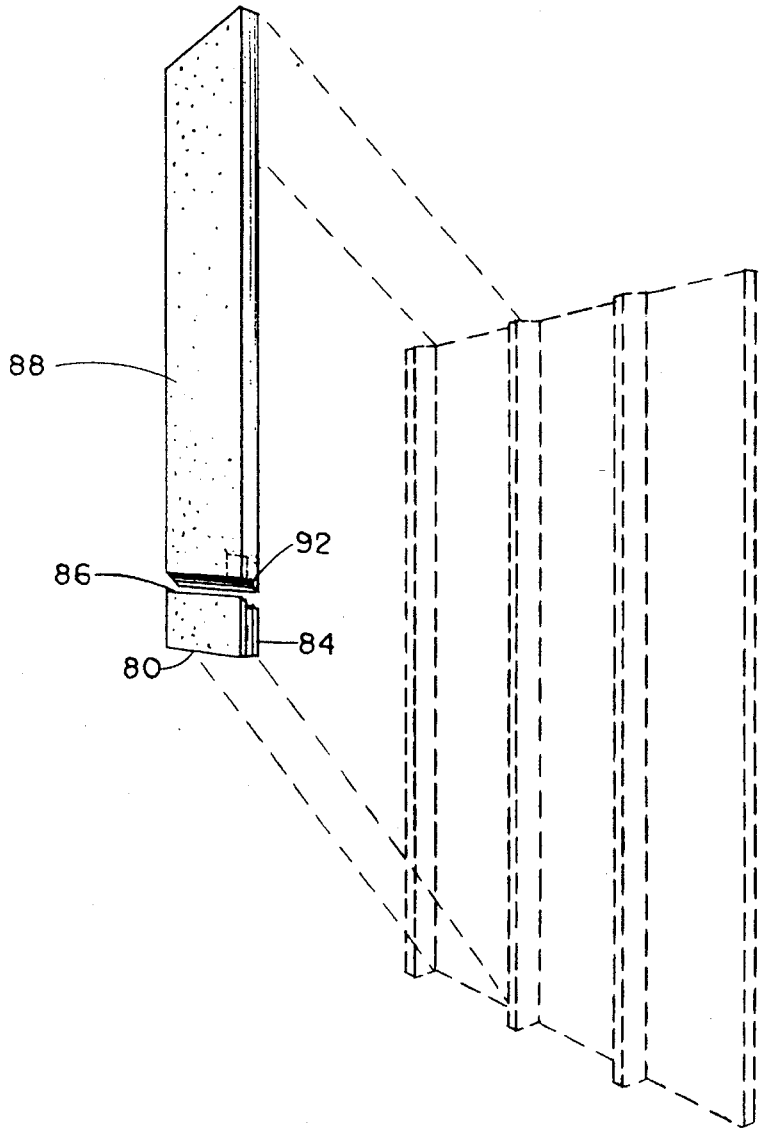
FIG. 9 is an exploded view, similar to FIG. 1, and showing details of a rigid insulation designed to fit into the stud space of a wall structure made in accordance with the present invention.
Figure 10:
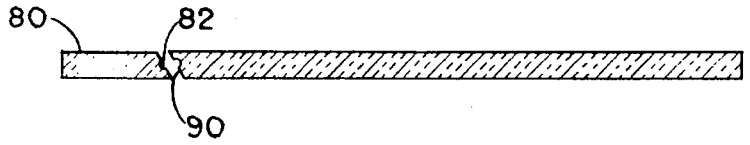
FIG. 10 is a side elevational view, showing details of the rigid insulation of FIG. 9.
Figure 11:
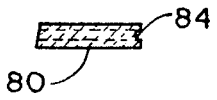
FIG. 11 is a top plan view of the rigid insulation of FIG. 9.

As noted supra, the wall panel assemblies of the present invention are designed to accommodate conventional fiberglass or rigid insulation. Alternatively, as shown in FIGS. 9–11, the wall insulation in accordance with a preferred embodiment of the present invention comprises a rigid foam such as extruded polystyrene, expanded polystyrene or the like. Alternatively, the rigid insulation may comprise recycled newsprint or the like in a blown binder. The rigid insulation comprises a two-piece panel assembly including a first, lower piece 80 which is molded to include a horizontal groove or race 82 formed in the top edge thereof, and a vertical groove or race 84 formed along one side edge. Lower piece 80 has a height which matches the height of the preformed knock-out cores 50 so as to accommodate wire runs through the wall. Preferably the top edge 86 of the lower piece 80 is tapered, for example, 15°–35° so as to permit loading of the upper section 88 as will be described in detail hereinafter. The lower edge 90 of upper piece 88 is beveled to match the bevel of lower piece 80, and includes a similar groove or race 92 for accommodating a wiring run.

The side edges of both the upper and lower pieces 88, 80 are beveled to fit the taper of the studs.

Making the rigid insulation in two pieces permits installation of the lower piece after the wiring has been installed through the wall. Once the wiring inspection is completed, the upper piece 88 of the insulation may be installed in the wall.

Figure 5:
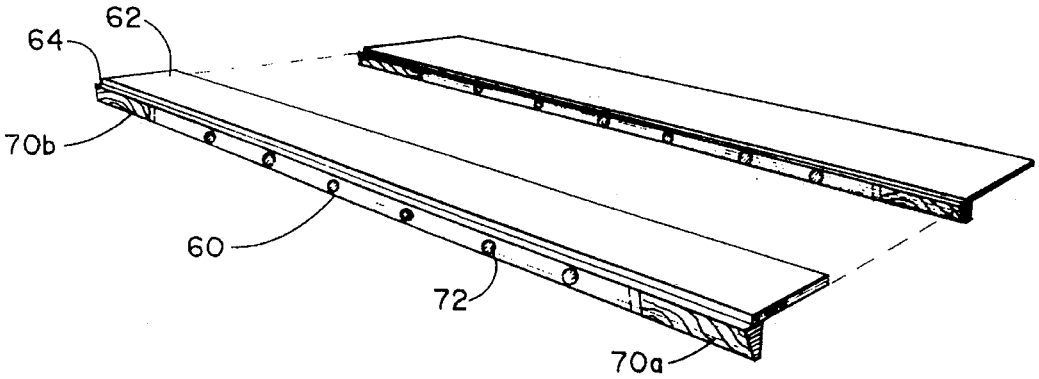
FIG. 5 is a side elevational view showing a floor and joist or roof and rafter panel structure made in accordance with the present invention.
Figure 6:
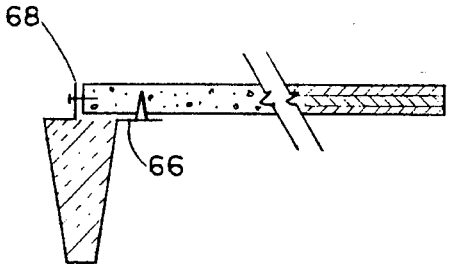
FIG. 6 is an end view of the structure shown in FIG. 5.
Figure 7:
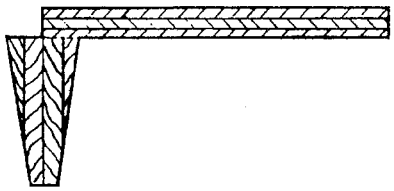
FIG. 7 is an enlarged end view similar to FIG. 6, and showing details of the interlock between adjacent floor panels.

The invention is susceptible to modification. Referring to FIGS. 5–7, the same concept advantageously may be employed for forming floor panel assemblies and roof rafter panel assemblies. Typically, however, since the floor and/or roof panels may be substantially longer than 8 feet, the panels will be made only 16 inch or 24 inch wide so that the assembled panel will not be so heavy that it cannot be handled by two workers. Accordingly, in the case of a 16 inch wide floor or roof panel assembly, it is sufficient to provide a stud member 60 only along one long edge of the panel 62. As before, joist/stud 60 may be integrally formed with the panel 62, or the joist/stud 60 may comprise a metal joist/stud which is affixed to the panel 62, for example, by gang nailing as before. Joist/stud 60 is similar to joist/stud 12*a* of FIG. 1, and is mounted to overlap the edge 64 of panel 62. As before, when separately formed, joist/stud 60 may be affixed to the panel by adhesive means, but preferably is affixed by mechanical fastening means such as gang nails integrally formed to an integral nailing strip 66 and integral leg 68. Adjacent panels are interlocked as before.

Joist/stud 60 may be wood fiber and/or foam-filled as in the case of studs 12*a*, 12*b*, 12*c*. Preferably at least the ends 70*a*, 70*b* of the joist/stud are wood fiber filled so as to facilitate cutting. Typically joist/stud 60 will be comparable in size to the wooden joist/stud they replace in conventional construction. Thus, for example, joist/stud 60 may be 5½×7¼, 9¼ or 11¼ inches deep or comparable sizes foreign markets in equivalent metric depths and/or sizes. Also, in order to facilitate wiring and/or plumbing on site, joist/stud 60 may be provided with knockout cores 72.

While I have illustrated and described with particular utility only a preferred form of my invention, it should be understood that various changes and modifications may be made without departing from the spirit and scope of my invention. Accordingly, the scope of my invention should be limited only by the scope of the hereinafter appended claims.

What is claimed is:

1. A modular building wall assembly comprising a rectangular panel member having a short edge and a long edge, and having at least one reinforcing stud member separate from said panel member and secured to one surface of the panel with fastening means, and running parallel to the long edge of the panel, wherein each stud member is truncated in cross section, and one stud member is located adjacent a long edge of the panel member and extends laterally beyond said edge, while the other long edge of the panel member is free from any reinforcing stud members, said panel member being formed of a wood or paper composite material, and said one stud member is formed of a fastenable material so that an adjacent modular building assembly may be affixed thereto by mechanical fastening means driven into the stud.

2. A modular building wall assembly according to claim 1, and comprising a plurality of reinforcing stud members, all located on said one surface of the panel member, and running parallel to the long edge of the panel member and to one another, and spaced equidistant from one another.

3. A modular building wall assembly according to claim 2, wherein said stud members are spaced 16 inches on center.

4. A modular building wall assembly according to claim 2, wherein said stud members are spaced 24 inches of center.

5. A modular building wall assembly according to claim 1, wherein said panel member is formed of a composite laminated or molded material.

6. A modular building wall assembly according to claim 1, wherein said stud members comprise metal-skinned elements.

7. A modular building wall assembly according to claim 6, wherein said stud members are filled at least in part with wood fiber.

8. A modular building wall assembly according to claim 6, wherein said stud members are filled at least in part with foam.

9. A modular building wall assembly according to claim 1, wherein said stud members are affixed to the panel member by adhesive means.

10. A modular building wall assembly according to claim 1, wherein said stud members are affixed to the panel member by mechanical fastening means.

11. A modular building wall assembly according to claim 10, wherein said mechanical fastening means are selected from the group consisting of nails, screws and staples.

12. A modular building wall assembly according to claim 10, wherein said stud members include at least one outwardly extending flange having integrally formed therein gang nails for affixing the stud members to the panel member.

13. A building wall comprising a plurality of modular building wall assemblies as claimed in claim 1, and including rigid insulation, friction-fitted into cavities between adjacent stud members, said rigid insulation having tapered side walls for matching the taper of said studs.

14. A building wall as claimed in claim 13, wherein said rigid foam comprises a first piece which includes a preformed wire race, and a matching piece, which in cooperation with the first piece fills the cavity.

15. A modular building wall assembly according to claim 1, and further comprising at least one header running perpendicular to said at least one stud member, affixed to said panel.

16. A modular building element comprising a rectangular panel member having a short edge and a long edge, and having at least one reinforcing stud member secured to one surface of the panel with fastening means, and running parallel to the long edge of the panel, wherein each stud member is truncated in cross section, and one stud member is located adjacent a long edge of the panel member and extends laterally beyond said edge, while the other long edge of the panel member is free from any reinforcing stud members, said panel member being formed of a composite material, and said one stud member is formed of a fastenable material so that an adjacent modular building assembly may be affixed thereto by mechanical fastening means driven into the stud, and wherein said studs include preformed holes with knockout cores for accommodating wires or plumbing.

17. A modular building element according to claim 16, and comprising a plurality of reinforcing stud members, all located on said one surface of the panel member, and running parallel to the long edge of the panel member and to one another, and spaced equidistant from one another.

18. A modular building element according to claim 17, wherein said stud members are spaced 16 inches on center.

19. A modular building element according to claim 17, wherein said stud members are spaced 24 inches of center.

20. A modular building element according to claim 16, wherein said panel member is formed of a composite laminated or molded material.

21. A modular building element according to claim 16, wherein said stud members comprise metal-skinned elements.

22. A modular building element according to claim 21, wherein said stud members are filled at least in part with wood fiber.

23. A modular building element according to claim 21, wherein said stud members are filled at least in part with foam.

24. A modular building element according to claim 16, wherein said stud members are affixed to the panel member by adhesive means.

25. A modular building element according to claim 16, wherein said stud members are affixed to the panel member by mechanical fastening means.

26. A modular building element according to claim 25, wherein said mechanical fastening means are selected from the group consisting of nails, screws and staples.

27. A modular building element according to claim 25, wherein said stud members include at least one outwardly extending flange having integrally formed therein gang nails for affixing the stud members to the panel member.

28. A building wall comprising a plurality of modular building elements as claimed in claim 16, and including rigid insulation, friction-fitted into cavities between adjacent stud members, said rigid insulation having tapered side walls for matching the taper of said studs.

29. A building wall as claimed in claim 28, wherein said rigid foam comprises a first piece which includes a preformed wire race, and a matching piece, which in cooperation with the first piece fills the cavity.

30. A modular building element according to claim 16, and further comprising at least one header running perpendicular to said at least one stud member, affixed to said panel.

* * * * *

UNITED STATES PATENT AND TRADEMARK OFFICE

CERTIFICATE OF CORRECTION

PATENT NO. : 5,581,969

DATED : December 10, 1996

INVENTOR(S) : Stephen L. Kelleher

It is certified that error appears in the above-indentified patent and that said Letters Patent is hereby corrected as shown below:

Claim 16, Column 6, Line 46, insert --separate from said panel member and-- after "member".

Signed and Sealed this

Twenty-seventh Day of May, 1997

*Attest:*

Bruce Lehman

BRUCE LEHMAN

*Attesting Officer*

*Commissioner of Patents and Trademarks*